US006550770B1

(12) United States Patent
Rackliff

(10) Patent No.: US 6,550,770 B1
(45) Date of Patent: Apr. 22, 2003

(54) CHESS GAME

(76) Inventor: Larry A. Rackliff, 453 S. Shore Dr., Owls Head, ME (US) 04854

( * ) Notice: Subject to any disclaimer, the term of this patent is extended or adjusted under 35 U.S.C. 154(b) by 0 days.

(21) Appl. No.: 10/014,204

(22) Filed: Nov. 9, 2001

(51) Int. Cl.[7] ..... A63F 3/00
(52) U.S. Cl. ..... 273/261; 273/262; D21/334
(58) Field of Search ..... 273/260, 261, 273/262, 255, 388; D25/338, 334, 348, 365

(56) References Cited

U.S. PATENT DOCUMENTS

D132,919 S 6/1942 Vanek
3,730,527 A 5/1973 Nelson
3,741,547 A 6/1973 Zurek
4,036,501 A * 7/1977 Hovnanian ..... 273/258
4,856,789 A 8/1989 Carlson
5,421,582 A 6/1995 Ritter
5,492,332 A 2/1996 Hessnice

* cited by examiner

*Primary Examiner*—Benjamin H. Layno

(57) ABSTRACT

A chess game including a game board having a grid pattern of game spaces thereon which includes non-movement spaces and movement spaces. The non-movement spaces form a pair of V-shaped open areas positioned adjacent to one of the ends and opening toward each. A plurality of chess pieces includes a plurality of kings, knights, and pawns. A first player has chess pieces that include one king, six knights and ten pawns. A second player has chess pieces that include one king, six knights and ten pawns. The players position their chess pieces on opposite ends of the chess board. Players may not move their chess pieces onto or over the non-movement spaces. The game is won by the player who first removes the other players king from the board.

15 Claims, 2 Drawing Sheets

CHESS GAME

BACKGROUND OF THE INVENTION

1. Field of the Invention

The present invention relates to chess games and more particularly pertains to a new chess game for providing user with enjoyment while playing the game.

2. Description of the Prior Art

The use of chess games is known in the prior art. U.S. Pat. No. 3,730,527 describes a device for a checkerboard time game. Another type of chess games is U.S. Pat. No. 5,421, 582 having a game board similar to a chessboard.

While these devices fulfill their respective, particular objectives and requirements, the need remains for a game adding the challenge of an irregular shaped chess playing area having non-moving spaces therein for teaching strategy.

SUMMARY OF THE INVENTION

The present invention meets the needs presented above by including a pair of game boards each having irregular shaped playing areas with respect to each other and with respect to conventional chess boards.

To this end, the present invention generally comprises at least one game board having a grid pattern of game spaces thereon including non-movement spaces and movement spaces. The game board includes a grid including 20 columns and 9 rows wherein column 1 and column 20 define opposite ends of the grid and row 1 and row 9 define opposite edges of the grid. The non-movement spaces form a pair of V-shaped open areas positioned adjacent to one of the ends and opening toward each. A plurality of chess pieces includes a plurality of kings, knights, and pawns. The chess pieces are divided into two sets of differently colored chess pieces such that a first set and a second set are defined. Each of the chess pieces is movable only on the movement spaces. Only one chess piece may be positioned in any one movement space. A pair of players selects one of the first and second sets of chess pieces. The first player has chess pieces that include one king, six knights and ten pawns. The chess pieces of the first player are positioned in columns 1–5. The second player has chess pieces that include one king, six knights and ten pawns, the chess pieces of the second player is positioned in columns 16–20. Moving of the chess pieces in turn by each of the players such that chess pieces are removed from the game board when the game space occupied by that chess piece is occupied by an opposing player's chess piece. Wherein the game is one by the player who first removes the other players king from the board.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
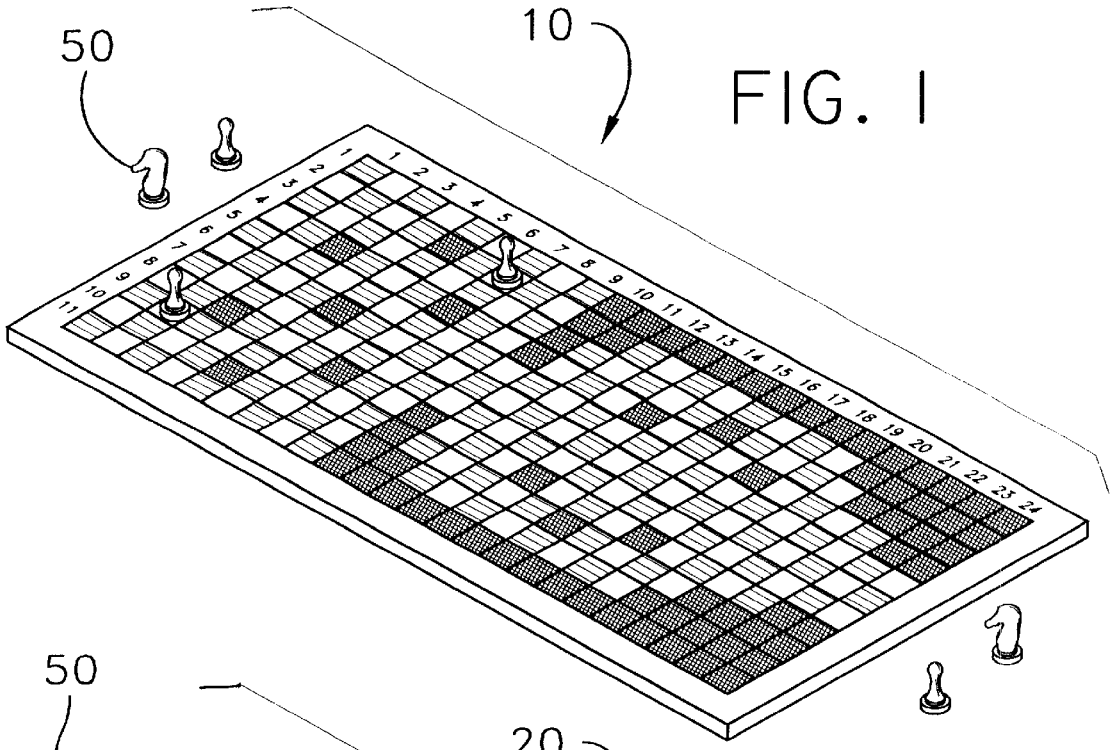
FIG. 1 is a perspective view of a new chess game according to the present invention.
Figure 2:
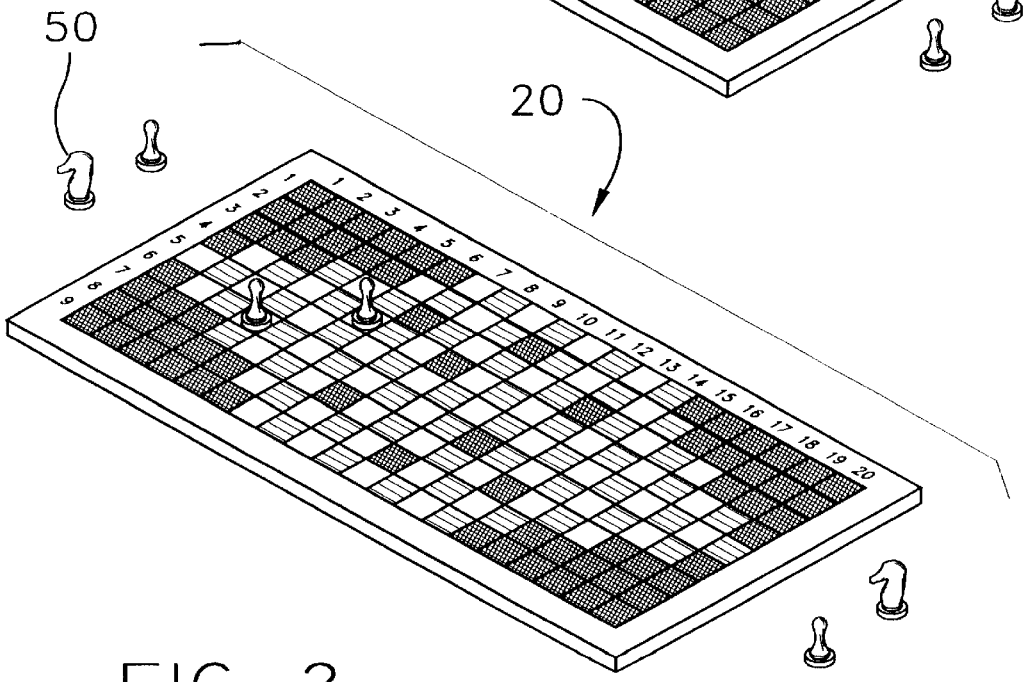
FIG. 2 is a perspective view of the present invention.

With reference now to the drawings, and in particular to FIGS. 1 through 4 thereof, a new chess game embodying the principles and concepts of the present invention and generally designated by the reference numeral 10 will be described.

The game ideally comprises a pair of game boards, though it is understood that each of the game boards may be provided by itself. Each of the games boards each has a grid pattern of game spaces thereon, but each is elongated such that there are more columns than rows. The game spaces include non-movement spaces 30 and movement spaces 40. A first of the game boards 10 has a different number of columns and rows to form the grid pattern than a second of the game boards 20. The non-movement spaces on the first board are positioned in a different location than the non-movement spaces on the second board.

Figure 3:
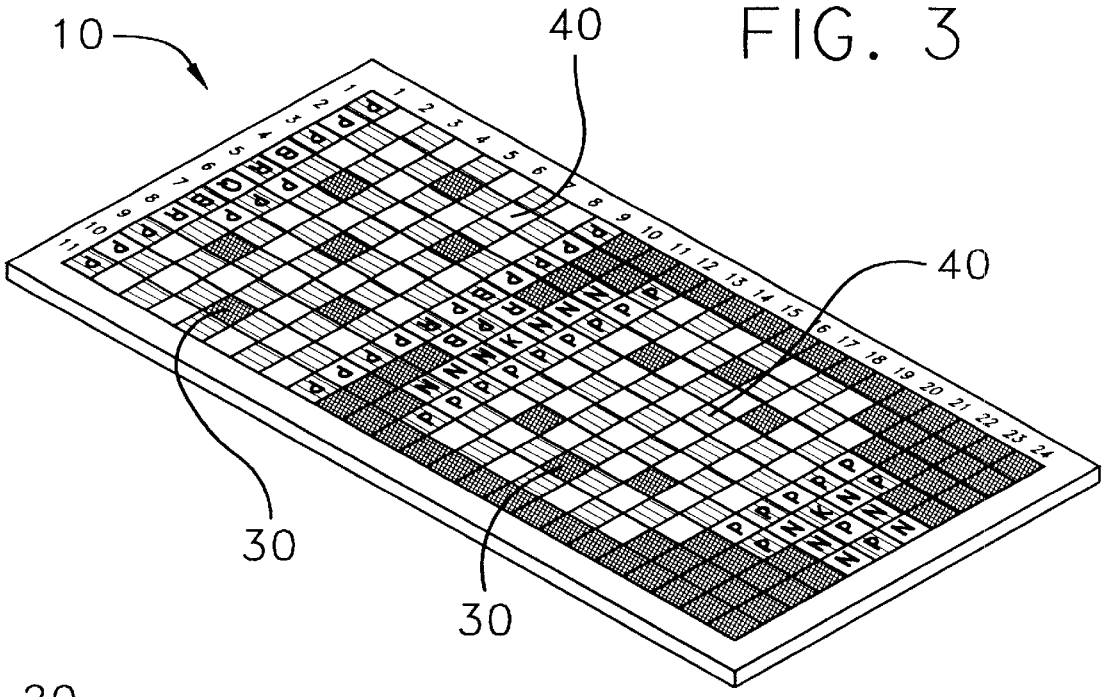
FIG. 3 is a top view of the present invention.

The first game board is depicted on FIGS. 1 and 3 and has a grid including 24 columns and 11 rows wherein column 1 and column 24 define opposite ends of the grid and row 1 and row 11 define opposite edges of the grid. The grid includes a first portion and a second portion, the first portion extends from column 1 to column 9.

The non-movement spaces of the first game board form a peripheral wall around a generally open area of movement spaces in the second portion. An opening defined by a plurality of movement spaces extends into the second portion from the first portion. No non-movement spaces are positioned in rows 5, 6 or 7 from columns 10 through 24. Two spaced non-movement spaces are positioned in each of columns 3 and 7. Three spaced non-movement spaces are positioned in column 5. Two spaced non-movement spaces are positioned in the open area of columns 14, 16 and 18.

The second game board includes a grid with 20 columns and 9 rows wherein column 1 and column 20 define opposite ends of the grid and row 1 and row 9 define opposite edges of the grid. The grid includes a first portion and a second portion. The first portion extends from column 1 to column 9.

The non-movement spaces on the second game board form a pair of V-shaped open areas positioned adjacent to one of the ends and opening toward each. No non-movement spaces are positioned in row 5 and no non-movement spaces are positioned in rows 1 and 9 from column 7 through 14. Each of the columns 7 through 14 has one randomly positioned non-movement space therein.

The game includes a plurality of conventional chess pieces 50 including kings, queens, bishops, rooks, knights, and pawns. The chess pieces are conventionally divided into two sets of differently colored chess pieces such that a first set and a second set are defined. Each of the chess pieces is movable only on the movement spaces. Only one chess piece may be positioned in any one movement space. The kings are movable one movement space in any direction. The queens are movable one movement space in any direction. The bishops are movable a selected number of movement spaces along a diagonal line. The rooks are movable any selected number of movement spaces along a straight line. The knights are selectively movable in a straight line either three movement spaces in one direction and one movement space in another or one movement space in one direction and three movement spaces in another. The pawns are selectively movable one or two movement spaces forward, diagonally or sideways. As can be seen from above, the chess pieces have the same movements as in traditional chess with the exception of the queens and pawns. The chess pieces are moved in turn by each of the, players such that chess pieces are removed from the game board when the game space occupied by that chess piece is occupied by an opposing player's chess piece.

Figure 4:
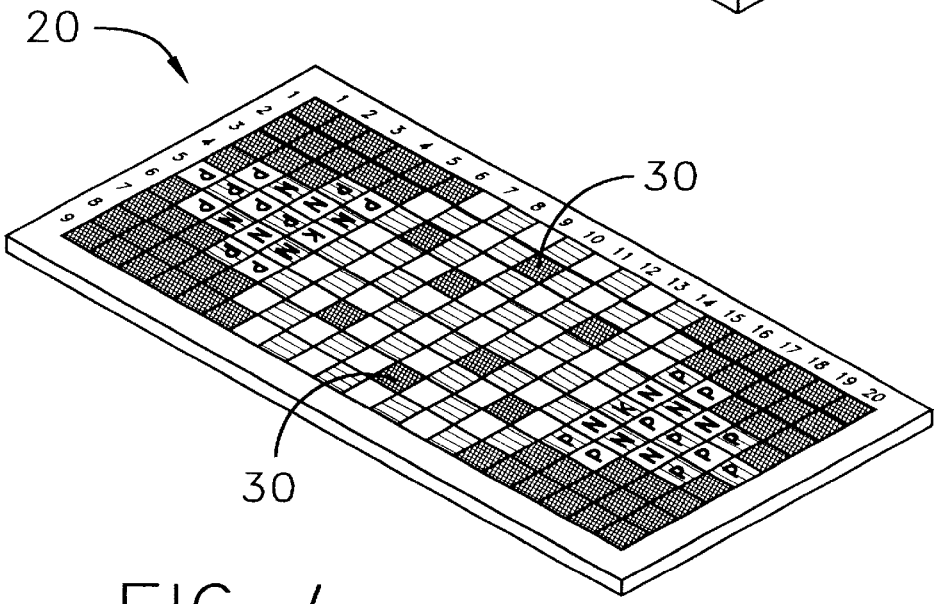
FIG. 4 is a top view of the present invention.

Rules of the Game:

In order to facilitate the understanding of placement of the chess pieces, FIGS. 3 and 4 have been included showing the placement of the chess pieces on the game boards. The following is a key for the chess pieces with respect to FIGS. 3 and 4.

K=king

Q=queen

B=bishop

R=rook

N=knight

P=pawn

Each of a pair of players selects one of the sets of chess pieces. The players then decide which board they are going to play on as the pieces to be used and the rule differ slightly.

First Game Board:

If the first board is selected, a first player has chess pieces including one king, one queen, two bishops, two rooks, six knights, and eighteen pawns. Generally, the first player positions the queen in the first portion and the king in the second portion. A remainder of first player chess pieces is divided and positioned adjacent to the king and queen.

Specifically, the positioning of the chess pieces is defined below in a (row, column) format:

one queen positioned at (6,1);

two rooks positioned at (5,1) and (8,1);

two bishops positioned at (4,1) and (7,1), six pawns is positioned at (1–3,1) and (9–11,1);

three pawns is positioned at (5–7,2);

five pawns is positioned at (4–8,21);

one king positioned at (6,22);

two knights is positioned at (5,22) and 7,22);

two pawns positioned at (4,22) and (8,22)

one pawn positioned at (6,23);

one pawn positioned at (6,24);

one pair of knights positioned at (5,23) and (7,23); and one pair of knights positioned at (5,24) and (7,24).

The second player receives chess pieces including one king, two bishops, two rooks, six knights, and nineteen pawns. The second player's chess pieces are positioned generally at a juncture of the first and second portions.

Specifically, the second chess player's chess pieces are positioned as follows:

nine pawns positioned at (1–4, 9), (8–11, 9) and (6,9);

nine pawns positioned at (2–10,12);

one bishop positioned at (5,9);

one rook positioned at (7,9);

one rook positioned at (5,10);

one pawn positioned at (6,10);

one bishop positioned at (7,10);

one king positioned at (6,11); and six knights positioned at (3–5,11) and (7–9,11).

The first player wins the game by moving the king to a position adjacent to the queen. The second player wins the game by capturing the king or queen of the first player.

Second Game Board:

If the first board is selected, The first player has chess pieces including one king, six knights and ten pawns. Generally, the chess pieces of the first player are positioned in columns 1–5.

Specifically, the chess pieces of first player are positioned as follows:

pawns positioned at (1,5), (4–6,2), (5,3), (3,4), (5,4), (7,4), (3,5) and (7,5);

knights positioned at (4,3), (6,3), (4,4), (6,4), (4,5) and (6,5); and one king positioned at (5,5).

The second player has chess pieces including the second player has chess pieces including one king, six knights and ten pawns. Generally, the chess pieces of the second player is positioned in columns 16–20.

Specifically, the chess pieces of the second player are positioned as follows:

pawns positioned at (20,5), (4–6,19), (5,18), (3,17), (5,17), (7,17), (3,16) and (7,16);

knights positioned at (4,18), (6,18), (4,17), (6,17), (4,16) and (6,16); and one king positioned at (5,16).

The game of the second game board is one by the player who first removes the other players king from the board.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a chess game comprising the steps of:

a game board having a grid pattern of game spaces thereon, said game spaces including non-movement spaces and movement spaces, said game board including;

a grid including 24 columns and 11 rows wherein column 1 and column 24 define opposite ends of the grid and row 1 and row 11 define opposite edges of the grid, said grid including a first portion and a second portion, said first portion extending from column 1 to column 9;

said non-movement spaces forming a peripheral wall around a generally open area of movement spaces in said second portion, an opening defined by a plurality of movement spaces extending into said second portion from said first portion;

providing a plurality of chess pieces including a plurality of kings, queen, bishops, rooks, knights, and pawns, said chess pieces being divided into two sets of differently colored chess pieces such that a first set and a second set are defined, each of said chess pieces being movable only on said movement spaces, only one chess piece may be positioned in any one movement space;

providing a pair of players;

selecting one of said first and second sets of chess pieces;

positioning of said chess pieces selected by said first player, said first player having chess pieces including one king, one queen, two bishops, two rooks, six knights, and eighteen pawns, said first player positioning said queen in said first portion and said king in said second portion, a remainder of first player chess pieces being divided and positioned adjacent to the king and queen;

positioning of said chess pieces selected by said second player, said second player having chess pieces including one king, two bishops, two rooks, six knights, and nineteen pawns, said second player's chess pieces being positioned generally at a juncture of said first and second portions;

moving of said chess pieces in turn by each of said players such that chess pieces are removed from the game board when the game space occupied by that chess piece is occupied by an opposing player's chess piece; and wherein said first player wins the game by moving the king to a position adjacent to the queen, wherein said second player wins the game by capturing the king or queen of the first player.

2. The method of playing a chess game as in claim 1, wherein no non-movement spaces are positioned in rows 5,6 or 7 from columns 10 through 24, two spaced non-movement spaces being positioned in each of columns 3 and 7, three spaced non-movement spaces being positioned in column 5, two spaced non-movement spaces being positioned in the open area of columns 14, 16 and 18.

3. The method of playing a chess game as in claim 2, said kings being movable one movement space in any direction, said queen being movable one movement space in any direction, said bishops being movable a selected number of movement spaces along a diagonal line, said rooks being movable any selected number of movement spaces along a straight line, said knights being selectively movable in a straight line either three movement spaces in one direction and one movement space in another or one movement space in one direction and three movement spaces in another, said pawn being selectively movable one or two movement spaces forward, diagonally or sideways.

4. The method of playing a chess game as in claim 2, wherein the step of positioning of said chess pieces further includes the following steps;

said first player positioning of said chess pieces defined in a (row, column) format;
one queen positioned at (6,1);
two rooks positioned at (5,1) and (8,1);
two bishops positioned at (4,1) and (7,1);
six pawns being positioned at (1–3,1) and (9–11,2);
three pawns being positioned at (5–7,2);
five pawns being positioned at (4–8,21);
one king positioned at (6,22);
two knights being positioned at (5,22) and 7,22);
two pawns positioned at (4,22) and (8,22)
one pawn positioned at (6,23);
one pawn positioned at (6,24);
one pair of knights positioned at (5,23) and (7,23); and
one pair of knights positioned at (5,24) and (7,24);

said second player positioning of said chess pieces defined in a (row, column) format;
nine pawns positioned at (1–4,9), (8–11,9) and (6,9);
nine pawns positioned at (2–10,12);
one bishop positioned at (5,9);
one rook positioned at (7,9);
one rook positioned at (5,10);
one pawn positioned at (6,10);
one bishop positioned at (7,10);
one king positioned at (6,11); and six knights positioned at (3–5,11) and (7–9,11).

5. The method of playing a chess game as in claim 1, said kings being movable one movement space in any direction, said queen being movable one movement space in any direction, said bishops being movable a selected number of movement spaces along a diagonal line, said rooks being movable any selected number of movement spaces along a straight line, said knights being selectively movable in a straight line either three movement spaces in one direction and one movement space in another or one movement space in one direction and three movement spaces in another, said pawns being selectively movable one or two movement spaces forward, diagonally or sideways.

6. The method of playing a chess game as in claim 5, wherein the step of positioning of said chess pieces further includes the following steps;

said first player positioning of said chess pieces defined in a (row, column) format;
one queen positioned at (6,1);
two rooks positioned at (5,1) and (8,1);
two bishops positioned at (4,1) and (7,1);
six pawns being positioned at (1–3,1) and (9–11,1);
three pawns being positioned ate (5–7,2);
five pawns being positioned at (4–8,21);
one king positioned at (6,22);
two knights being positioned at (5,22) and 7,22);
two pawns positioned at (4,22) and (8,22)
one pawn positioned at (6,23);
one pawn positioned at (6,24);
one pair of knights positioned at (5,23) and (7,23); and
one pair of knights positioned at (5,24) and (7,24);

said second player positioning of said chess pieces defined in a (row, column) format;
nine pawns positioned at (1–4,9), (8–11,9) and (6,9);
nine pawns positioned at (2–10,12);
one bishop positioned at (5,9);
one rook positioned at (7,9);
one rook positioned at (5,10);
one pawn positioned at (6,10);
one bishop positioned at (7,10);
one king positioned at (6,11); and six knights positioned at (3–5,11) and (7–9,11).

7. The method of playing a chess game as in claim 1, wherein the step of positioning of said chess pieces further includes the following steps;

said first player positioning of said chess pieces defined in a (row, column) format;
one queen positioned at (6,1);
two rooks positioned at (5,1) and (8,1);
two bishops positioned at (4,1) and (7,1);
six pawns being positioned at (1–3,1) and (9–11,1);
three pawns being positioned at (5–7,2)

five pawns being positioned at (4–8,21);
one king positioned at (6,22);
two knights being positioned at (5,22) and 7,22);
two pawns positioned at (4,22) and (8,22)
one pawn positioned at (6,23);
one pawn positioned at (6,24);
one pair of knights positioned at (5,23) and (7,23); and
one pair of knights positioned at (5,24) and (7,24);

said second player positioning of said chess pieces defined in
a (row, column) format;
nine pawns positioned at (1–4,9), (8–11,9) and (6,9);
nine pawns positioned at (2–10,12);
one bishop positioned at (5,9);
one rook positioned at (7,9);
one rook positioned at (5,10);
one pawn positioned at (6,10);
one bishop positioned at (7,10);
one king positioned at (6,11); and
six knights positioned at (3–5,11) and (7–9,11).

8. A method of playing a chess game comprising the steps of:

a game board having a grid pattern of game spaces thereon, said game spaces including non-movement spaces and movement spaces, said game board including;
a grid including 20 columns and 9 rows wherein column 1 and column 20 define opposite ends of the grid and row 1 and row 9 define opposite edges of the grid;
said non-movement spaces forming a pair of V-shaped open areas positioned adjacent to one of the ends and opening toward each;

providing a plurality of chess pieces including a plurality of kings, knights, and pawns, said chess pieces being divided into two sets of differently colored chess pieces such that a first set and a second set are defined, each of said chess pieces being movable only on said movement spaces, only one chess piece may be positioned in any one movement space;

providing a pair of players;

selecting one of said first and second sets of chess pieces;

positioning of said chess pieces selected by said first player, said first player having chess pieces including one king, six knights and ten pawns, said chess pieces of the first player being positioned in columns 1–5;

positioning of said chess pieces selected by said second player, said second player having chess pieces including one king, six knights and ten pawns, said chess pieces of the second player being positioned in columns 16–20;

moving of said chess pieces in turn by each of said players such that chess pieces are removed from the game board when the game space occupied by that chess piece is occupied by an opposing player's chess piece; and wherein the game is won by the player who first removes the other players king from the board.

9. The method of playing a chess game as in claim 8, wherein no non-movement spaces are positioned in row 5 and no non-movement spaces are positioned in rows 1 and 9 from column 7 through 14, each of the columns 7 through 14 having one randomly positioned non-movement space therein.

10. The method of playing a chess game as in claim 9, wherein said kings are movable one movement space in any direction, said knights being selectively movable in a straight line either three movement spaces in one direction and one movement space in another or one movement space in one direction and three movement spaces in another, said pawns being selectively movable one or two movement spaces forward, diagonally or sideways.

11. The method of playing a chess game as in claim 9, wherein the step of positioning of said chess pieces further includes the following steps;

positioning of said first player chess pieces as defined in a (row, column) format;
pawns positioned at (1,5), (4–6,2), (5,3), (3,4), (5,4), (7,4), (3,5) and (7,5);
knights positioned at (4,3), (6,3), (4,4), (6,4), (4,5) and (6,5); and
one king positioned at (5,5);

positioning of said second player chess pieces as defined in a (row, column) format;
pawns positioned at (20,5), (4–6,19), (5,18), (3,17), (5,17), (7,17), (3,16) and (7,16);
knights positioned at (4,18), (6,18), (4,17), (6,17), (4,16) and (6,16); and one king positioned at (5,16).

12. The method of playing a chess game as in claim 8, wherein said kings are movable one movement space in any direction, said knights being selectively movable in a straight line either three movement spaces in one direction and one movement space in another or one movement space in one direction and three movement spaces in another, said pawns being selectively movable one or two movement spaces forward, diagonally or sideways.

13. The method of playing a chess game as in claim 12, wherein the step of positioning of said chess pieces further includes the following steps;

positioning of said first player chess pieces as defined in a (row, column) format;
pawns positioned at (1,5), (4–6,2), (5,3), (3,4), (5,4), (7,4), (3,5) and (7,5);
knights positioned at (4,3), (6,3), (4,4), (6,4), (4,5) and (6,5); and
one king positioned at (5,5);

positioning of said second player chess pieces as defined in a (row, column) format;
pawns positioned at (20,5), (4–6,19), (5,18), (3,17), (5,17), (7,17), (3,16) and (7,16);
knights positioned at (4,18), (6,18), (4,17), (6,17), (4,16) and (6,16); and one king positioned at (5,16).

14. The method of playing a chess game as in claim 8, wherein the step of positioning of said chess pieces further includes the following steps;

positioning of said first player chess pieces as defined in a (row, column) format;
pawns positioned at (1,5), (4–6,2), (5,3), (3,4), (5,4), (7,4), (3,5) and (7,5);
knights positioned at (4,3), (6,3), (4,4), (6,4), (4,5) and (6,5); and
one king positioned at (5,5);

positioning of said second player chess pieces as defined in a (row, column) format;
pawns positioned at (20,5), (4–6,19), (5,18), (3,17), (5,17), (7,17), (3,16) and (7,16);
knights positioned at (4,18), (6,18), (4,17), (6,17), (4,16) and (6,16); and
one king positioned at (5,16).

15. A method of playing a chess game comprising the steps of:

providing a pair of games boards each having a grid pattern of game spaces thereon, said game spaces including non-movement spaces and movement spaces, said game boards including a first game board and a second game board each having a different number of columns and rows to form said grid pattern, wherein said non-movement spaces on said first board are positioned in a different location than said non-movement spaces on said second board, said first game board including;

a grid including 24 columns and 11 rows wherein column 1 and column 24 define opposite ends of the grid and row 1 and row 11 define opposite edges of the grid, said grid including a first portion and a second portion, said first portion extending from column 1 to column 9;

said non-movement spaces forming a peripheral wall around a generally open area of movement spaces in said second portion, an opening defined by a plurality of movement spaces extending into said second portion from said first portion, wherein no non-movement spaces are positioned in rows 5, 6 or 7 from columns 10 through 24, two spaced non-movement spaces being positioned in each of columns 3 and 7, three spaced non-movement spaces being positioned in column 5, two spaced non-movement spaces being positioned in the open area of columns 14, 16 and 18;

said second game board including;

a grid including 20 columns and 9 rows wherein column 1 and column 20 define opposite ends of the grid and row 1 and row 9 define opposite-edges of the grid, said grid including a first portion and a second portion, said first portion extending from column 1 to column 9;

said non-movement spaces forming a pair of V-shaped open areas positioned adjacent to one of the ends and opening toward each, wherein no non-movement spaces are positioned-in row 5 and no non-movement spaces are positioned in rows 1 and 9 from column 7 through 14, each of the columns 7 through 14 having one randomly positioned non-movement space therein;

providing a plurality of chess pieces including a plurality of kings, queens, bishops, rooks, knights, and pawns, said chess pieces being divided into two sets of differently colored chess pieces such that a first set and a second set are defined, each of said chess pieces being movable only on said movement spaces, only one chess piece may be positioned in any one movement space, said kings being movable one movement space in any direction, said queens being movable one movement space in any direction, said bishops being movable a selected number of movement spaces along a diagonal line, said rooks being movable any selected number of movement spaces along a straight line, said knights being selectively movable in a straight line either three movement spaces in one direction and one movement space in another or one movement space in one direction and three movement spaces in another, said pawns being selectively movable one or two movement spaces forward, diagonally or sideways;

providing a pair of players;

selecting one of said first and second sets of chess pieces;

selection one of said first and second game boards, wherein selecting the first game board additionally comprises the steps of;

positioning of said chess pieces selected by said first player, said first player having chess pieces including one king, one queen, two bishops, two rooks, six knights, and eighteen pawns, said first player positioning said queen in said first portion and said king in said second portion, a remainder of first player chess pieces being divided and positioned adjacent to the king and queen, wherein positioning of said chess pieces is defined in a (row, column) format;

one queen positioned at (6,1);

two rooks positioned at (5, 1) and (8,1);

two bishops positioned at (4,1) and (7,1);

six pawns being positioned at (1–3,1) and (9–11,1);

three pawns being positioned at (5–7,2);

five pawns being positioned at (4–8,21);

one king positioned at (6,22);

two knights being positioned at (5,22) and 7,22);

two pawns positioned at (4,22) and (8,22)

one pawn positioned at (6,23);

one pawn positioned at (6,24);

one pair of knights positioned at (5,23) and (7,23); and one pair of knights positioned at (5,24) and (7,24);

positioning of said chess pieces selected by said second player, said second player having chess pieces including one king, two bishops, two rooks, six knights, and nineteen pawns, said second player's chess pieces being positioned generally at a juncture of said first and second portions, wherein positioning of said chess pieces is defined in a (row, column) format;

nine pawns positioned at (1–4, 9), (8–11, 9) and (6,9);

nine pawns positioned at (2–10,12);

one bishop positioned at (5,9);

one rook positioned at (7,9);

one rook positioned at (5,10);

one pawn positioned at (6,10);

one bishop positioned at (7,10);

one king positioned at (6,11); and six knights positioned at (3–5,11) and (7–9,11);

moving of said chess pieces in turn by each of said players such that chess pieces are removed from the game board when the game space occupied by that chess piece is occupied by an opposing player's chess piece;

wherein said first player wins the game by moving the king to a position adjacent to the queen, wherein said second player wins the game by capturing the king or queen of the first player;

wherein selecting the second game board additionally comprises the steps of;

positioning of said chess pieces selected by said first player, said first player having chess pieces including one king, six knights and ten pawns, said chess pieces of the first player being positioned in columns 1–5, wherein positioning of said chess pieces is defined in a (row, column) format;

pawns positioned at (1,5), (4–6,2), (5,3), (3,4), (5,4), (7,4), (3,5) and (7,5);

knights positioned at (4,3), (6,3), (4,4), (6,4), (4,5),and (6,5); and one king positioned at (5,5);

positioning of said chess pieces selected by said second player, said second player having chess pieces including one king, six knights and ten pawns, said chess pieces of the second player being positioned in columns 16–20, wherein positioning of said chess pieces is defined in a (row, column) format;

pawns positioned at (20,5), (4–6,19), (5,18), (3,17), (5,17), (7,17), (3,16) and (7,16);

knights positioned at (4,18), (6,18), (4,17), (6,17), (4,16) and (6,16); and one king positioned at (5,16);

moving of said chess pieces in turn by each of said players such that chess pieces are removed from the game board when the game space occupied by that chess piece is occupied by an opposing player's chess piece; and wherein the game is won by the player who first removes the other players king from the board.

* * * * *